US009873146B2

(12) United States Patent
Schreiber et al.

(10) Patent No.: US 9,873,146 B2
(45) Date of Patent: Jan. 23, 2018

(54) FORGING MACHINE

(71) Applicant: Danieli & C. Officine Meccaniche S.P.A., Buttrio (IT)

(72) Inventors: Marco Schreiber, Brescia (IT); Angelo Furinghetti, Novara (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 15/115,873

(22) PCT Filed: Feb. 9, 2015

(86) PCT No.: PCT/IB2015/050956
§ 371 (c)(1),
(2) Date: Aug. 1, 2016

(87) PCT Pub. No.: WO2015/118502
PCT Pub. Date: Aug. 13, 2015

(65) Prior Publication Data

US 2017/0008067 A1 Jan. 12, 2017

(30) Foreign Application Priority Data

Feb. 10, 2014 (IT) ..... MI2014A0185

(51) Int. Cl.
*B21J 7/32* (2006.01)
*B30B 1/32* (2006.01)
(Continued)

(52) U.S. Cl.
CPC . *B21J 7/14* (2013.01); *B21J 7/28* (2013.01); *B21J 7/32* (2013.01); *B30B 1/265* (2013.01); *B30B 1/32* (2013.01)

(58) Field of Classification Search
CPC ..... B21J 7/14; B21J 7/28; B21J 7/32; B30B 1/265; B30B 1/32
See application file for complete search history.

(56) References Cited

U.S. PATENT DOCUMENTS 4,671,095 A * 6/1987 Brignoli ..... B21J 7/14 72/403

FOREIGN PATENT DOCUMENTS

| | | |
|---|---|---|
| EP | 0677197 | 10/1995 |
| EP | 1093871 | 4/2001 |
| GB | 2157602 | 10/1985 |

* cited by examiner

*Primary Examiner* — Teresa M Ekiert
(74) *Attorney, Agent, or Firm* — Stetina Brunda Garred & Brucker

(57) ABSTRACT

A forging machine with one or more hammers, comprising, for each hammer, an eccentric shaft (1) adapted to rotate about a first axis; a connecting rod (2), adapted to be actuated by the eccentric shaft operating as crank; a guiding frame (10); wherein the hammer is adapted to perform an alternating working movement within said guiding frame along a second axis perpendicular to the first axis; wherein the hammer comprises a hydraulic cylinder (8) provided with a hollow body (5), to which a forging member (15) is externally fixed, and with a piston (3) at least partially inserted within said hollow body and removably coupled to the connecting rod; wherein a first hydraulic chamber (6), arranged between piston and hollow body, allows to move the hollow body away from and/or towards said piston; wherein uncoupling means are provided for uncoupling the piston from the connecting rod.

15 Claims, 3 Drawing Sheets

(51) Int. Cl.

| | |
|---|---|
| ***B21J 7/14*** | (2006.01) |
| ***B21J 7/28*** | (2006.01) |
| ***B30B 1/26*** | (2006.01) |

FORGING MACHINE

CROSS REFERENCE TO RELATED APPLICATIONS

The present application claims priority to PCT International Application No. PCT/IB2015/050956 filed on Feb. 9, 2015, which application claims priority to Italian Patent Application No. MI2014A000185 filed Feb. 10, 2014, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a machine for radial forging with one or more hammers, in which each hammer performs a forward-backward working stroke actuated by an eccentric mechanism.

PRIOR ART

In the case of radial forging with multiple hammers, the operating principle is that of simultaneous machining of the incoming metallic product by means of several hammers, e.g. four hammers, which operate radially with respect to the longitudinal introduction axis of the metallic product to be hammered.

During processing, the hammers perform a short forward-backward stroke and are actuated, specifically, by a connecting rod-crank-slider-link type mechanism, in which the crank is an eccentric shaft and the link is a cylinder guided within a sleeve.

A kinematic chain, generally formed by gears, connects the eccentric shafts of the machine mechanisms to one another, thus synchronizing the strokes of the hammers connected to the respective cylinder.

The eccentric shaft is connected to the traction system directly in axis or by means of the foregoing kinematic chain.

The eccentric shaft is made so as to obtain a high flywheel inertia which allows to develop a higher cyclic force than that which can be generated by means of the average torque supplied by the traction system itself on the material being processed alone.

Normally in this system, the constraint between connecting rod and cylinder is a two-way constraint, i.e. it opposes both a traction force and a compression force. Solutions in which such a constraint is a one-way constraint, i.e. capable of opposing to compression forces only are present in the prior art, e.g. in EP0667197B1. The contact is maintained between connecting rod and cylinder, even when the two would tend to separate, by a mechanical or hydraulic spring which operates on the cylinder in the direction of the eccentric shaft defining the crank.

Disadvantageously, this type of machine is dedicated, i.e. can only work as a swaging machine, i.e. with a short working stroke (given by the eccentricity of the shaft) and high frequencies (given by the rotation speed of the eccentric shaft).

Furthermore, a screw/nut-screw connection is provided between the two parts forming the cylinder in EP0667197B1. This type of connection, whose function is to modify the length of the cylinder, and consequently the position of the hammer, can perform only slow movements of the hammer, only in a condition in which it is not under load and cannot absorb any overloads coming from the material during processing. Therefore, this connection is subject to oversizing, wear and failures.

There are less common solutions in which the system which actuates the hammers consists of a hydraulic cylinder fixed to the frame of the forging machine and actuated by means of forging valves. In such solutions, longer working strokes can be generated at lower frequencies thus using the machine for forging the material with higher penetrations. Therefore, in this case, the machine works as a traditional forging press. However, the operation of the machine with short strokes and high frequency, i.e. as a swaging machine, has a lower frequency and the hammer synchronicity thereof is less reliable; furthermore, energy efficiency is much lower.

The need is therefore felt to make an innovative forging machine which allows to overcome the aforesaid drawbacks.

SUMMARY OF THE INVENTION

It is the main purpose of the present invention to provide a radial forging machine, e.g. with two, three or four hammers, which can be used efficiently both as a swaging machine (short working strokes and high frequency) and as a traditional forging press (longer hammer working strokes, low frequencies and modular forging speed).

It is a further object of the present invention to provide a radial forging machine which may work alternatively with a connecting rod/crank control or with a hydraulic control only.

It is another object of the present invention to provide a radial forging machine which allows to set the position of the hammer in simple, rapid manner, while allowing to protect the machine from overloads.

The present invention thus aims to reach the objects discussed above by making a forging machine with one or more hammers which, in accordance with claim 1, comprises for each hammer:

- an eccentric shaft, adapted to rotate about a first axis,
- a connecting rod, adapted to be actuated by said eccentric shaft operating as crank,
- and a guiding frame,
- wherein the hammer is adapted to perform an alternating working movement within said guiding frame along a second axis perpendicular to the first axis,
- wherein the hammer comprises a hydraulic cylinder provided with a hollow body, to which a forging member is externally fixed, and a piston at least partially inserted within said hollow body and removably coupled to the connecting rod,
- wherein a first hydraulic chamber, arranged between piston and hollow body, allows to move the hollow body away from and/or towards said piston,
- wherein uncoupling means are provided for uncoupling the piston from the connecting rod, so that after uncoupling the hammer can be actuated hydraulically in alternating manner by means of the first hydraulic chamber, while when the piston is coupled to the connecting rod the hammer can be actuated mechanically in alternating manner by means of the eccentric shaft-connecting rod assembly and the first hydraulic chamber allows to adjust the average working position of the hammer along the second axis.

A second aspect of the present invention relates to a switching method for the aforesaid forging machine from operating as a swaging machine to operating as a traditional forging press, said method according to claim 12 comprising the following steps of a) providing the piston and the connecting rod in reciprocal contact so that the hammer is mechanically actuated in alternating manner by means of the eccentric shaft-connecting rod assembly, with the first hydraulic chamber which allows to adjust only the average working position of the hammer along the second axis, the machine working as a swaging machine;

b) uncoupling the piston from the connecting rod by means of the uncoupling means so that the hammer can be actuated hydraulically in alternating manner, alternating an input and an output of liquid from the first hydraulic chamber, the machine working as a forging press.

A further aspect of the invention relates to a switching method for the aforesaid forging machine from operating as a forging press to operating as a swaging machine, said method comprising the steps of claim 14.

In the machine of the invention, each eccentric shaft is connected to a respective connecting rod by means of a low friction cylindrical body, or simply bearing. A hammer, comprising an hydraulic cylinder, is free to move axially in direction perpendicular to the axis of the eccentric shaft, and is maintained in contact with the connecting rod by means of a low friction member (slider) by the hydraulic pressure present in an annular chamber which behaves as a hydraulic compensation spring.

The eccentric shaft is rotated by means of a traction system and, in a first operating mode, imposes an alternating motion of width equal to double the eccentricity of the shaft and of frequency equal to the rotation frequency of the shaft itself on the hydraulic cylinder by means of the connecting rod.

A forging member is connected rigidly, yet removably to allow replacement, to the end part of the hydraulic cylinder, and is thus subject to the same alternating motion so as to act on the product being processed.

The hydraulic cylinder consists of a piston and a liner or hollow body, between which there is formed a further hydraulic chamber. This further hydraulic chamber allows to adjust the length of the cylinder: by inserting the required amount of oil inside said further chamber it is possible to move the liner away from or towards the piston so as to obtain the proper position at which the forging member will operate on the product.

Said further hydraulic chamber also operates as protection means of the machinery in case of overloads: indeed, in these cases, the oil present in this further chamber can be discharged by means of a maximum pressure valve, thus protecting the members constituting the machine.

By virtue of the simple mechanics and the accuracy of the hammer synchronicity kinematism, this first operating mode, named swaging machine mode, allows to reach very high working frequencies, with short working stroke of the hammer for all material penetrations.

If working with long working strokes, lower frequencies and modular forging speed is needed, an exclusively hydraulic control can, in addition, be used without the use of the mechanical transmission comprising the eccentric shaft and the connecting rod, but operating hydraulically on the aforesaid hydraulic chamber by varying the length of the hydraulic cylinders and consequently the radial position of the forging member. In such a second operating mode, named traditional forging press mode, the bearing between connecting rod and eccentric shaft is not rotating and therefore must be preserved from excessive loads, particularly if the bearing is of the hydrodynamic type. Therefore, in this second operating mode, the force exerted by the hydraulic cylinder on the material which is processed must not be discharged onto the bearing.

In order to activate this second operating mode, the aforesaid uncoupling or disengaging means separate the hydraulic cylinder from the eccentric control. In a preferred variant, a wedge guided firmly in the structure of the machine runs between two extreme positions:

a disengaged wedge position (swaging machine operating mode), in which a clearance is always maintained between the lower surface of the wedge and the upper surface of the piston, regardless of the working position of the piston itself;

and an engaged wedge position (forging press operating mode), in which a clearance is always maintained between connecting rod and piston.

Once the piston is separated from the connecting rod/crank control, the machine can be used by hydraulically operating on the hydraulic chamber between piston and liner, by varying the length of the cylinder, and consequently the position of the forging member in alternating manner. The machine can also be made to work with long strokes, and thus in forging operating mode, since it is possible to move the liner or hollow body, and thus the forging member, away from the piston as desired, by either filling or emptying the aforesaid hydraulic chamber. In this mode, a lower frequency is nom ally required with respect to the swaging press mode, controlled by means of a connecting rod-crank system, which on the contrary has short strokes and high frequencies.

Therefore, the forging machine, object of the present invention, has the following advantages in particular:

to allow to forge also slowly and with long working strokes, by deactivating the connecting rod-crank mechanism and operating with an exclusively hydraulic control;

to allow to forge by modulating the forging speed, by deactivating the connecting rod-crank mechanism and operating with an exclusively hydraulic control;

to set the position of the hammer in hydraulic manner during machine use in swaging press mode;

to protect the machine from overloads in both operating modes.

The dependent claims describe preferred embodiments of the invention.

BRIEF DESCRIPTION OF THE FIGURES

Further features and advantages of the invention will be more apparent in light of the detailed description of a preferred, but not exclusive, embodiment of a forging machine illustrated by way of non-limitative example, with reference to the accompanying drawings, in which.

The same reference numbers in the figures identify the same members or components.

DETAILED DESCRIPTION OF A PREFERRED EMBODIMENT OF THE INVENTION

Figure 1:
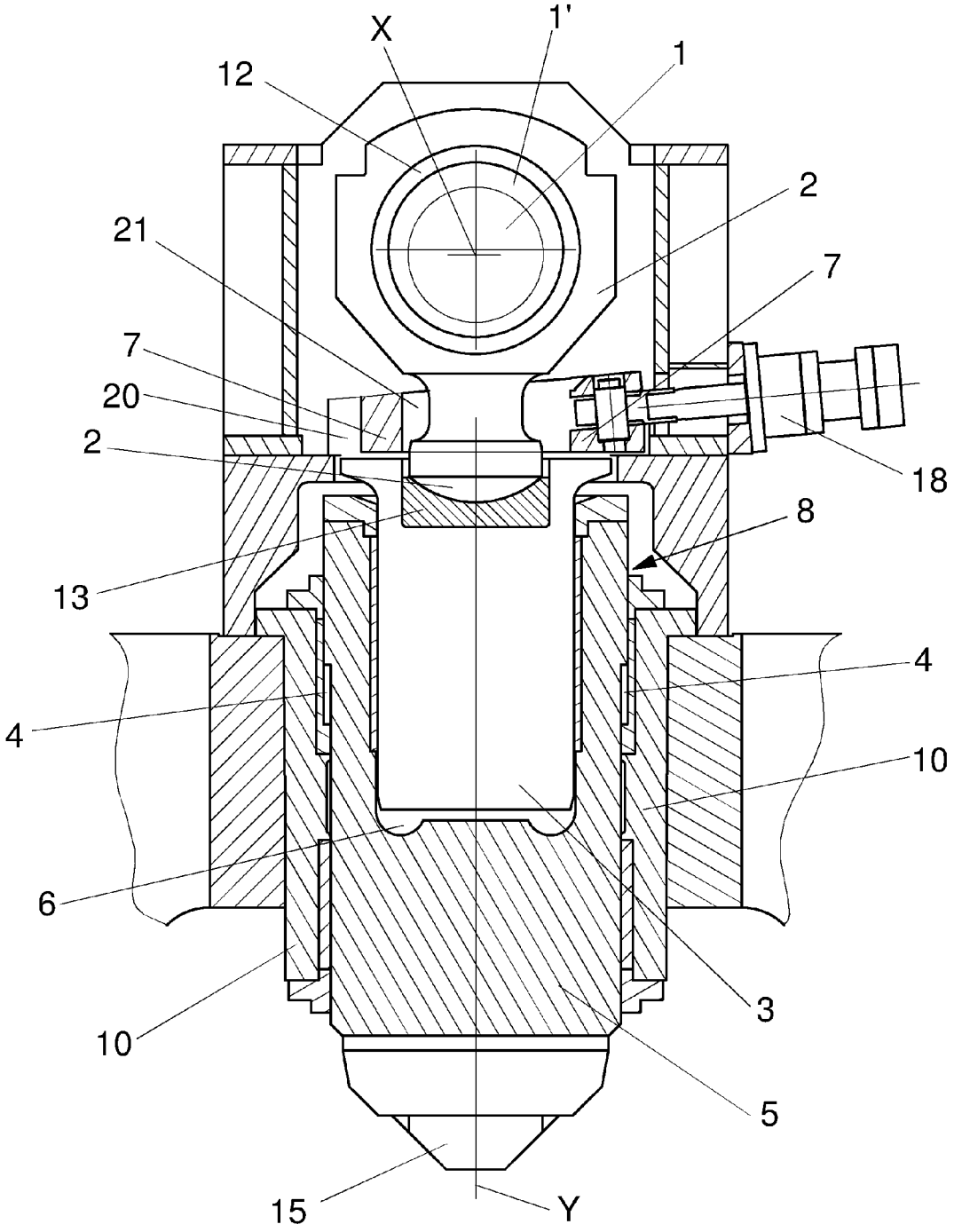
FIG. 1 shows a first section view of part of a machine according to the invention in a first operating mode as swaging press.

The figures show a preferred embodiment of part of a radial forging machine with one or more hammers which, according to the invention, can operate as a swaging machine or as a traditional forging press.

Operating as a swaging machine means an operation of the machine with short hammer working strokes, e.g. in the order of a value either lower than or equal to 80 mm, and high frequencies, e.g. in the order of 2-8 Hz.

Operating as a traditional forging machine means an operation of the machine with longer working strokes of the hammers, e.g. in the order of a value either lower than or equal to 500 mm, low frequencies, e.g. in the order of a value lower than 3 Hz, and modular forging speed up to a value either lower than or equal to 500 mm/s.

The machine object of the present invention comprises for each hammer:

- an eccentric shaft 1, adapted to rotate about a first axis X,
- a connecting rod 2, adapted to be actuated by said eccentric shaft 1 operating as crank,
- a guiding frame 10 for guiding the hammer in its alternating working movement.

The eccentric shaft 1 is provided with an eccentric portion 1' with respect to first axis X to which the connecting rod 2 is hinged. A bearing 12, preferably but not necessarily a hydrodynamic (oil film) bearing, is provided between connecting rod 2 and eccentric portion 1'.

Each hammer, adapted to perform an alternating working movement within the respective guiding frame 10 along a second axis Y perpendicular to the first axis X, comprises a hydraulic cylinder 8.

Figure 2:
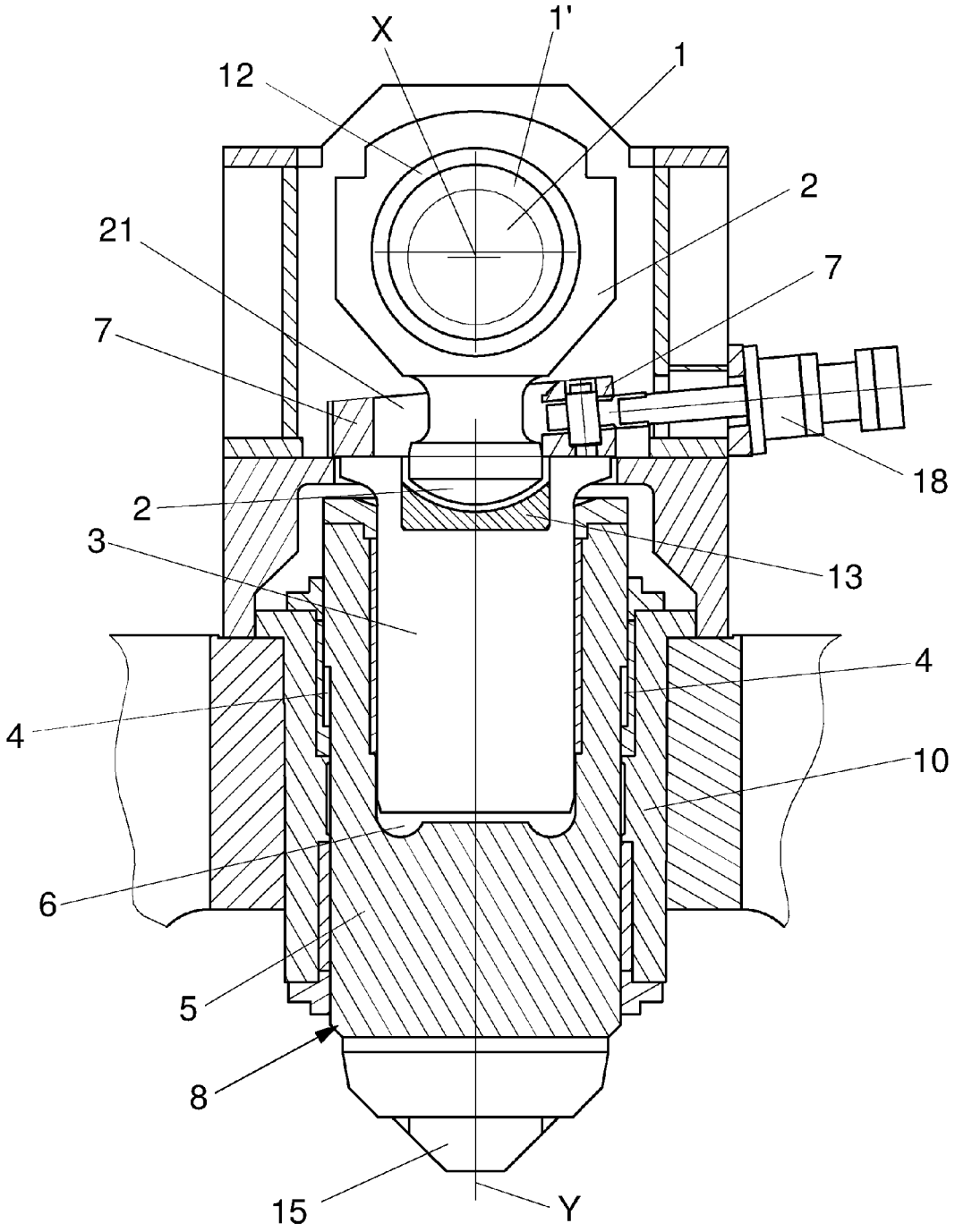
FIG. 2 shows a second section view of said machine according to the invention in a second operating mode as forging machine.
Figure 3:
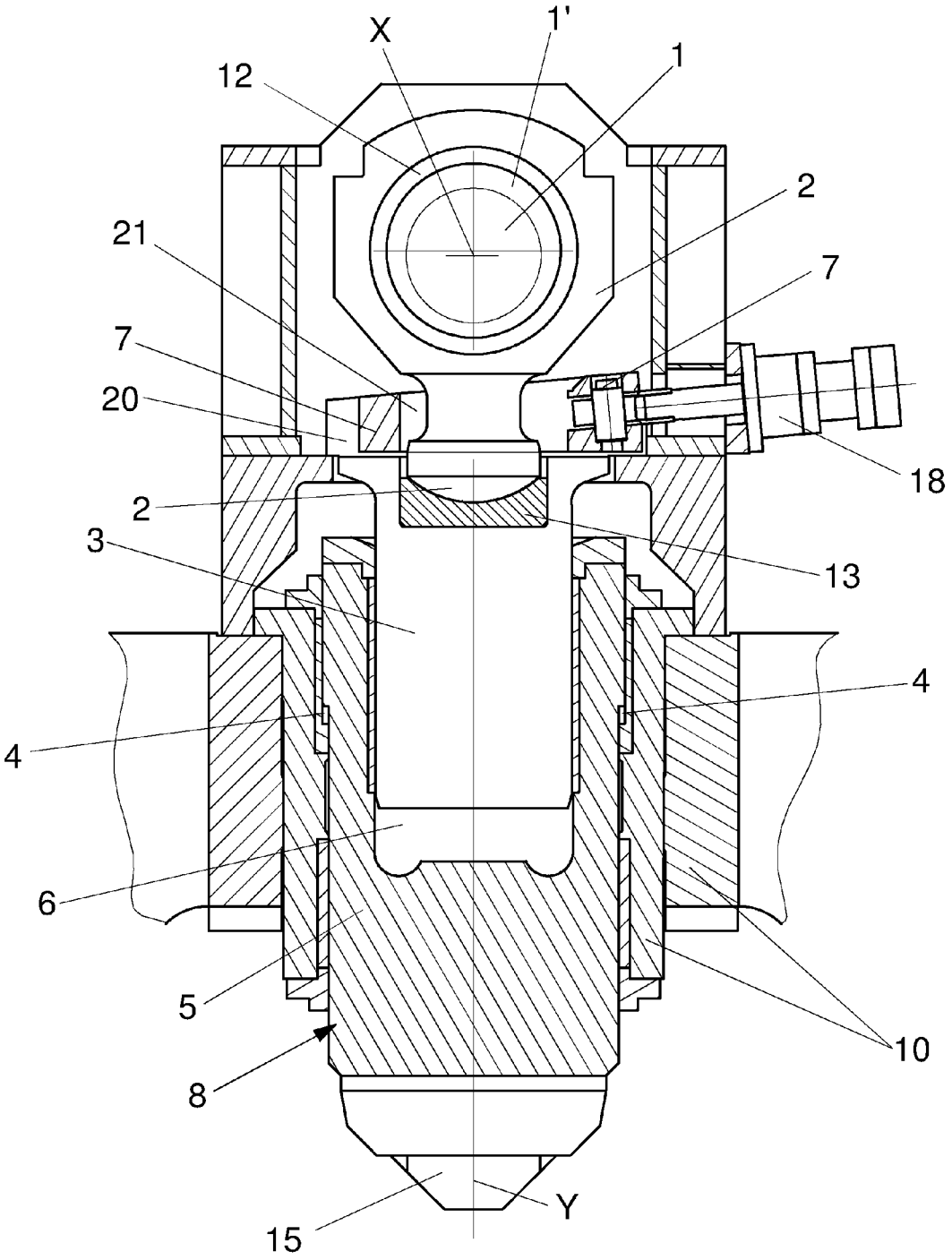
FIG. 3 shows a third section view of said part of machine according to the invention in the first operating mode as swaging press, with hydraulic cylinder in extended operating position.

Such a hydraulic cylinder 8 is provided with a hollow body 5, distal with respect to the connecting rod 2, to which a forging member 15 is externally fixed, and with a piston 3, proximal to the connecting rod 2 and at least partially inserted in the hollow body 5. The forging member 15 is preferably always arranged outside the guiding frame 10. However, it cannot be excluded that the forging member 15 is, in a retracted position, at least partially inside the guiding frame 10. Advantageously, the piston 3 is coupled in removable manner to the connecting rod 2 (FIGS. 1 and 2).

A low friction member 13 is generally provided, arranged between the piston 3 and the connecting rod 2, integrally fixed to the piston 3 and preferably housed in a cavity of the piston 3 itself.

The hydraulic cylinder 8 also comprises a hydraulic chamber 6, arranged between piston 3 and hollow body 5, which by introducing a liquid inside, e.g. hydraulic oil, allows to move the hollow body 5, and thus the forging member 15, away from the piston 3. Instead, the hollow body 5 can be moved towards to the piston 3 by letting liquid out from the hydraulic chamber 6. The inlet and outlet channels of the hydraulic oil connected to the hydraulic chamber 6, in common in the hydraulic cylinders, are not shown in the figures.

Advantageously, uncoupling means are provided for uncoupling the piston 3 from the connecting rod 2.

In a preferred variant, such uncoupling means comprise an actuator 18 which actuates a wedge 7, arranged in a cavity 20 of the structure of the machine provided between eccentric shaft 1 and piston 3 and which can move within said cavity, so that when the wedge 7 is in a first operating position, or first end position (FIG. 2), a contact is provided between wedge 7 and piston 3 and a clearance is provided between piston 3 and connecting rod 2, while when the wedge 7 is in a second operating position, or second end position (FIG. 1), a contact is provided between piston 3 and connecting rod 2 and a clearance is provided between wedge 7 and piston 3.

The actuator 18 can be a hydraulic, pneumatic or mechanical jack, either automatically or manually actuated. The actuator 18 is fixed to a frame or main casing of the machine. The wedge 7 advantageously has a central hole 21 crossed by the end of the connecting rod 2 proximal to the piston 3.

In other variants, the uncoupling means can comprise, for example, a hydraulic slewing ring, electromechanical jacks coaxial with the hammer, disengagement means of the connecting rod with displacement of the connecting rod in rotated position off axis with respect to axis Y, the connecting rod itself but of the variable length type (mechanical or hydraulic).

In the first operating position (FIG. 2), i.e. after the uncoupling between piston 3 and connecting rod 2, the hammer can be actuated only hydraulically, in alternating manner, by means of the first hydraulic chamber 6. The machine can be made to work with long working strokes, and thus operating in forging press mode by moving the hollow body 5, and thus the forging member 15, alternatively away from or towards the piston 3 as desired, by either filling or emptying the hydraulic chamber 6. In this operating mode, it is further avoided that, during operation, the forging load is discharged onto the connecting rod 2, and thus onto the bearing 12 which is not rotating, because the thrust force on the piston 3 is discharged onto the main frame of the machine by means of the wedge 7 itself.

In the second operating position (FIG. 1), i.e. when piston 3 and connecting rod 2 are coupled, the hammer can be actuated mechanically in alternating manner by means of the eccentric shaft 1-connecting rod 2 assembly. In this case, the machine may work as a swaging machine, with short hammer working strokes and high oscillating frequencies. The hydraulic chamber 6 allows only to adjust the average working position of the hammer along the second axis Y by adjusting the amount of liquid therein. By virtue of the presence of a maximum pressure valve (not shown), associated to the hydraulic chamber 6, it is possible to prevent discharging the overloads on the connecting rod 2 and, thus, on the bearing 12 also in this operating mode as a swaging machine.

In a variant of the invention, the liquid can let in and out of the hydraulic chamber 6 by means of a servo valve so as to adjust the average working position of the hammer between one hammering strike and the other rapidly.

A second hydraulic chamber 4, of annular shape, is further provided between the guiding frame 10 and the hollow body 5 of the cylinder 8. This second hydraulic chamber 4 is used to guarantee the constant contact between piston 3 and wedge 7 when the wedge is in said first operating position. In particular, this contact is guaranteed by the hydraulic pressure present in the annular chamber 4, which behaves as a hydraulic compensation spring.

In a variant of the invention, said first operating condition occurs when the connecting rod 2 and the eccentric portion 1' of the shaft 1 are in high position, with reference to the figures.

When instead the wedge 7 is in the second operating position, the second hydraulic chamber 4 is used to guarantee the constant contact between piston 3 and connecting rod 2. The shortening of the cylinder 8 is guaranteed by the hydraulic pressure in the annular hydraulic chamber 4 which behaves as a hydraulic compensation spring.

The forging machine of the invention can be of the type with only one hammer or with two or more hammers, e.g. four hammers. In case of multiple hammers, the latter move radially with respect to the longitudinal advancement axis of the product to be processed. A kinematic chain connecting the eccentric shafts 1 of the single hammers is provided to synchronize the working strokes of all hammers of the same machine in swaging machine mode.

With the machine of the invention it is thus possible to switch from operation as a swaging machine to operation as a forging press. The operating method change consists of the following steps:

a) providing the piston 3 and the connecting rod 2 in reciprocal contact so that the hammer is mechanically actuated in alternating manner by means of the eccentric shaft 1-connecting rod 2 assembly, with the first hydraulic chamber 6 which allows to adjust only the average working position of the hammer along the second axis Y, the machine being able to work as a swaging machine;

b) uncoupling the piston 3 from the connecting rod 2 by means of the uncoupling means so that the hammer can be actuated hydraulically in alternating manner, alternating an input and an output of liquid from the first hydraulic chamber 6, the machine working as a forging press.

In step a) the wedge 7 is in said second operating position, with a clearance between wedge 7 and piston 3. After step b) the wedge 7 is in said first operating position with a contact provided between wedge 7 and piston 3.

Conversely, the switch from operating as a forging press to operating as a swaging machine occurs by means of the following steps;

c) providing the wedge 7 in the first operating position, with piston 3 and wedge 7 in contact with each other and with piston 3 and connecting rod 2 uncoupled from each other, so that the hammer can be actuated hydraulically in alternating manner, alternating an input and an output of liquid from the first hydraulic chamber 6, the machine being able to work as a forging press;

d) coupling the piston 3 to the connecting rod 2 by switching the wedge 7 from said first operating position to the second operating position, in which a clearance is provided between piston 3 and wedge 7, so that the hammer is actuated in alternating manner by means of the eccentric shaft 1-connecting rod 2 assembly, with the first hydraulic chamber 6 which allows to adjust only the average working position of hammer along the second axis Y, the machine being able to work as a swaging machine.

The invention claimed is:

1. A forging machine with one or more hammers, comprising for each hammer:

an eccentric shaft, adapted to rotate about a first axis, a connecting rod, adapted to be actuated by said eccentric shaft operating as crank, and a guiding frame, wherein each hammer of said one or more hammers is adapted to perform an alternating working movement within said guiding frame along a second axis perpendicular to the first axis, wherein each hammer comprises a hydraulic cylinder provided with a hollow body, to which a forging member is externally fixed, and a piston at least partially inserted within said hollow body and removably coupled to the connecting rod, wherein a first hydraulic chamber, arranged between the piston and the hollow body, allows to move the hollow body away from and/or towards said piston, wherein uncoupling means are provided for uncoupling the piston from the connecting rod, whereby after uncoupling each hammer can be actuated hydraulically in alternating manner by means of the first hydraulic chamber, while when the piston is coupled to the connecting rod each hammer can be actuated mechanically in alternating manner by means of the eccentric shaft-connecting rod assembly and the first hydraulic chamber allows to adjust an average working position of each hammer along the second axis.

2. The forging machine according to claim 1, wherein said uncoupling means comprise a wedge arranged in a cavity provided between the eccentric shaft and the piston, said wedge being controlled by an actuator whereby when the wedge is in a first operating position a contact is provided between the wedge and the piston and a clearance is provided between the piston and the connecting rod, while when the wedge is in a second operating position a contact is provided between the piston and the connecting rod and a clearance is provided between the wedge and the piston.

3. The forging machine according to claim 2, wherein the wedge and the actuator are connected to a frame of the forging machine.

4. The forging machine according to claim 2, wherein a second hydraulic chamber is provided, configured to maintain a constant contact between the piston and the wedge when the wedge is in said first operating position, and configured to maintain a constant contact between the piston and the connecting rod when the wedge is in said second operating position.

5. The forging machine according to claim 4, wherein said second hydraulic chamber has an annular shape and is provided between the guiding frame and the hollow body.

6. The forging machine according to claim 1, wherein the first hydraulic chamber is provided with a maximum pressure valve, suitable to be actuated in case of overload when each hammer is mechanically actuated.

7. The forging machine according to claim 1, wherein the first hydraulic chamber is provided with a servo valve.

8. The forging machine according to claim 1, wherein a low friction member is provided between the piston and the connecting rod.

9. The forging machine according to claim 1, wherein a bearing is provided between the eccentric shaft and the connecting rod.

10. The forging machine according to claim 1, wherein said uncoupling means comprise a hydraulic slewing ring or electromechanical jacks coaxial with each hammer, or connecting rod disengagement members adapted to move the connecting rod to an off-axis position with respect to the second axis, or the connecting rod itself, the latter being of variable length type.

11. The forging machine according to claim 1, wherein there are provided a plurality of hammers of said one or more hammers moveable radially with respect to a longitudinal advancement axis of a product to be machined, and wherein a kinematic chain is provided, connecting the eccentric shafts of each hammer of the plurality of hammers, suitable to synchronize working strokes of the plurality of hammers.

12. A switching method for a forging machine, according to claim 1, for switching the forging machine from operating as swaging machine to operating as forging press, the method comprising the following steps of:

a) providing the piston and the connecting rod in reciprocal contact so that each hammer is mechanically actuated in alternating manner by means of the eccentric shaft connecting rod assembly, with the first hydraulic chamber which allows to adjust only the average working position of each hammer along the second axis, the forging machine working as swaging machine;

b) uncoupling the piston from the connecting rod by means of the uncoupling means so that each hammer can be actuated hydraulically in alternating manner, alternating an input and an output of liquid from the first hydraulic chamber, the forging machine working as a forging press.

13. The switching method according to claim 12, wherein in step a) the wedge is in said second operating position; and wherein after step b) the wedge is in said first operating position.

14. A switching method for a forging machine according to claim 1, for switching the forging machine from operating as forging press to operating as swaging machine, the switching method comprising the steps of:

a) providing the piston uncoupled from the connecting rod by means of the uncoupling means so that each hammer can be actuated hydraulically in alternating manner, alternating an input and an output of liquid from the first hydraulic chamber, the machine forging working as forging press;

b) coupling the piston to the connecting rod so that each hammer is mechanically actuated in alternating manner by means of the eccentric shaft connecting rod assembly, with the first hydraulic chamber which allows to adjust only the average working position of each hammer along the second axis, the forging machine working as swaging machine.

15. The switching method according to claim 14, wherein in step a) the wedge is in said first operating position; and wherein after step b) the wedge is in said second operating position.

* * * * *